United States Patent [19]

Kawakami

[11] 4,456,052

[45] Jun. 26, 1984

[54] APPARATUS FOR OSCILLATING A CONTINUOUS CASTING MOLD

[75] Inventor: Takashi Kawakami, Niihama, Japan

[73] Assignee: Concast Holding AG, Zurich, Switzerland

[21] Appl. No.: 490,780

[22] Filed: May 2, 1983

Related U.S. Application Data

[63] Continuation-in-part of Ser. No. 214,527, Dec. 8, 1980, abandoned.

[30] Foreign Application Priority Data

Dec. 19, 1979 [JP] Japan ..... 54-175885

[51] Int. Cl.[3] ..... B22D 11/04

[52] U.S. Cl. ..... 164/416; 164/478

[58] Field of Search ..... 164/478, 416, 71.1, 164/260, 261

[56] References Cited

U.S. PATENT DOCUMENTS

| | | | |
|---|---|---|---|
| 3,258,815 | 7/1966 | Reinfeld et al. | 164/416 |
| 3,638,714 | 2/1972 | Newhall et al. | 164/416 X |
| 3,664,409 | 5/1972 | Kolomeitsev et al. | 164/416 |
| 3,886,995 | 6/1975 | Bolrig et al. | 164/416 |
| 4,298,052 | 11/1981 | Knell et al. | 164/416 |

FOREIGN PATENT DOCUMENTS

| | | | |
|---|---|---|---|
| 2294005 | 7/1976 | France | 164/416 |
| 977267 | 12/1964 | United Kingdom | 164/416 |

*Primary Examiner*—Kuang Y. Lin

*Attorney, Agent, or Firm*—Werner W. Kleeman

[57] ABSTRACT

A continuous casting mold for casting strands is mounted in a mold table or other suitable mold mounting arrangement and is ocsillated by means of oscillation levers. The oscillation levers are mounted both at the mold table and also at a bearing block. To compensate the bearing play arising at the bearing locations a power or force-applying device is provided between the mold table and the bearing block.

1 Claim, 1 Drawing Figure

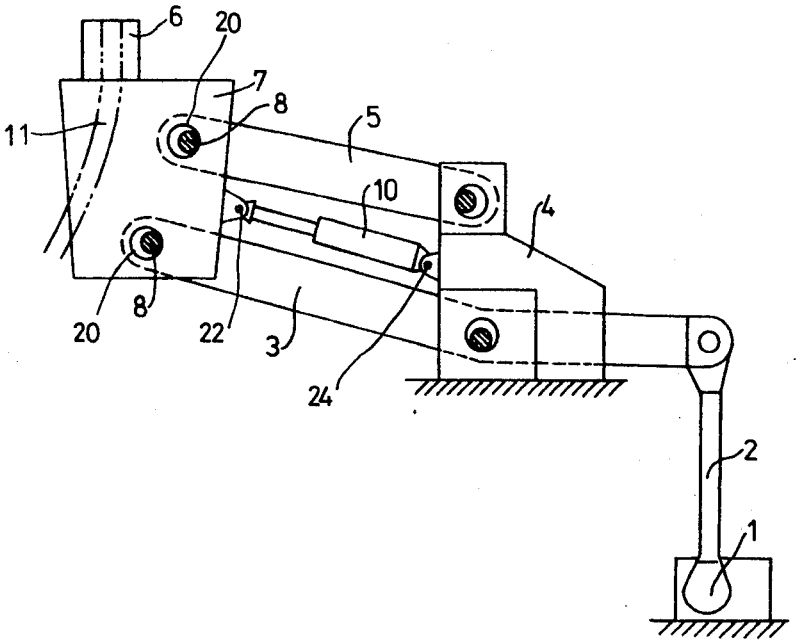
6
20
7
8
5
11
10
4
20
8
22
3
24
2
1

APPARATUS FOR OSCILLATING A CONTINUOUS CASTING MOLD

CROSS REFERENCE TO RELATED APPLICATION

This application is a continuation-in-part application of my commonly assigned, copending U.S. application Ser. No. 214,527, filed Dec. 8, 1980, and entitled "APPARATUS FOR OSCILLATING A CONTINUOUS CASTING MOLD," now abandoned.

BACKGROUND OF THE INVENTION

The present invention relates to a new and improved construction of apparatus for oscillating a continuous casting mold for the continuous casting of a strand.

Generally speaking, the mold oscillating apparatus of the present development is of the type comprising at least one oscillation lever which is mounted at a bearing block and is also hingedly connected with a guided mold table or other appropriate mold mounting arrangement which supports the continuous casting mold.

It is generally known in this technology to oscillate a mold along an arc, in order to thereby prevent any binding or sticking of the continuously cast strand which is formed within the mold and the mold wall which serves to shape such cast strand. Oscillation of the continuous casting mold improves the surface quality of the cast strand and prevents metal break-out from arising.

In U.S. Pat. No. 3,822,738 there is disclosed a prior art mold oscillation device which contains one or two short oscillation levers which are pivotably mounted at a bearing block. These levers are also hingedly connected with a mold table at which there is mounted a continuous casting mold. By means of an oscillation drive and a lifting rod the short oscillation levers are moved about their bearing locations in the bearing block.

During the oscillation of molds for casting slabs, especially at high speeds amounting to about more than 100 strokes per minute, vibrations in the mold oscillation system arise due to the high inertia forces and the prevailing bearing play at the bearing locations at the mold table. This impairs the quality of the cast product.

A further prior art oscillation device is disclosed in U.S. Pat. No. 3,343,592. Also with this state-of-the-art mold oscillation equipment it is possible for vibrations to occur during the casting of a strand.

SUMMARY OF THE INVENTION

Therefore, with the foregoing in mind, it is a primary object of the present invention to provide a new and improved construction of mold oscillation apparatus for a continuous casting mold which is not associated with the aforementioned drawbacks and limitations of the prior art construction.

Another and more specific object of the present invention aims at providing a new and improved construction of mold oscillation apparatus for a continuous casting mold which ensures for an exact and relatively vibration-free oscillatory movement of the continuous casting mold even when operated at higher oscillation speeds.

A further significant object of the present invention is directed to a new and improved construction of apparatus for oscillating a continuous casting mold, which mold oscillation apparatus incorporates means for compensating the bearing play of the mold oscillation system so as to afford relatively accurate and vibration-free oscillatory movements of the continuous casting mold even when the same is oscillated at relatively high oscillation speeds.

Now in order to implement these and still further objects of the invention, which will become more readily apparent as the description proceeds, the mold oscillation apparatus of the present development is manifested by the features that there is provided a mold table at which there is mounted a continuous casting mold. This mold table is supported and guided during the oscillation movement by two short oscillation levers. These two short oscillation levers are hingedly connected at one of their respective sides or ends by means of shafts with the mold table and are pivotably mounted at the other respective sides or ends thereof, again by means of shafts, at a rigidly or fixedly arranged bearing block. An oscillation drive serves to move or swivel one of the short levers about bearing locations thereof in the bearing blocks. Importantly, a power or force-applying device is operatively connected with the bearing block and the mold table in order to produce a force which extends or is effective approximately parallel to the direction of extent of the levers in order to continuously press the shafts in a defined direction at the related bearing location during the oscillatory movement, and to thereby thus compensate for any existing bearing play.

In this way, there can be applied compression or tension forces which compensate the bearing play at the bearing locations in that the shafts of the oscillation lever, mounted pivotably at the bearing, are pressed in a defined direction even while taking into account the weight of the mold table and the mold. Also in the presence of high inertia forces, which can arise during considerable oscillation speeds of more than about 100 strokes per minute, there is prevented the occurrence of vibrations in the oscillation system, and thus, there is beneficially ensured for quiet running and a good quality of the cast product.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE schematically illustrates a mold oscillating apparatus for oscillating a continuous casting mold according to the invention.

DETAILED DESCRIPTION OF THE PREFERRED EMBODIMENTS

Describing now the drawing, it is to be understood that only enough of the construction of a continuous casting machine or installation has been shown to enable those versed in the art to readily understand the underlying principles and concepts of the mold oscillation apparatus of the present development. Turning attention now to the single FIGURE of the drawing, there will be recognized a conventionally driven drive, here in the form of a driven eccentric 1 which cooperates with a lifting or reciprocable rod 2 or equivalent structure and acts upon a short mold oscillation lever 3 which, like a further short oscillation lever 5, is rotatably mounted in a bearing or support block 4 or equivalent structure. Each of both oscillation levers 3 and 5 is rigidly connected with a respective shaft 8 which is hingedly guided at both ends in suitable bearings, merely generally indicated by reference character 20, at the mold table 7. The expression "mold table" is used in its broader sense to encompass any suitable mold mounting or support structure as is conventionally employed in the continuous casting technology. Mounted upon the mold table 7 is a continuous casting mold 6, which in the embodiment under discussion serves for casting a steel slab 11. The mold table 7 and the continuous casting mold 6 are supported by the lower lever 3, and the upper lever 5 performs a guiding function during the mold oscillation movement. Both of the levers 3 and 5 each engage at both sides of the mold table 7. In place of the lever 5 the mold table 7 also could be guided by another guide structure, such as a slide guide arrangement.

According to the invention, a suitable power or force-applying device 10 is arranged between the bearing block 4 and the mold table 7 at the central region of such mold table. The power or force-applying device 10 may be advantageously in the form of a pressurized fluid medium cylinder arrangement 10, such as a hydraulic cylinder unit, which is hingedly connected at locations 22 and 24 at both the mold table 7 and the bearing block 4. This pressurized fluid medium cylinder arrangement 10 extends approximately parallel to the levers 3 and 5. There also could be provided two pressurized fluid medium cylinders arranged at each respective side of the mold table 7. By means of the cylinder unit 10, with the embodiment under discussion, there is exerted a pressure force upon the mold table 7. Consequently, the shafts 8, during the oscillatory movement of the continuous casting mold 6, are continuously pressed in a defined direction at the bearing locations during the mold oscillatory movement, and thus there is compensated for any prevailing bearing play. Hence, even at higher oscillation speeds, there is rendered possible an exact, vibration-free oscillatory movement of the continuous casting mold 6 in the strand withdrawal direction, and thus, there is obtained an improvement in the surface quality of the continuously cast strand 11.

Without the benefit of the arrangement of the inventive power or force-applying device 10 at low oscillation speeds the weight of the mold table 7 would be effective upon the top surface or side of the shafts 8 and with a bearing play of, for instance, 0.05 to 0.2 mm there would be possible a quiet oscillatory movement along a prescribed arc or circular path of travel. Yet, at higher mold oscillation speeds the weight of the mold table 7 and that of the mold 6 no longer would act upon the top side or surface of the shafts 8 and the surfaces of the shafts 8 against which there is applied the weight load would then be displaced towards the right and left of the showing of the drawing. As a result, there would arise vibrations of the mold table 7 along with the disadvantageous consequences heretofore discussed.

Instead of exerting a pressure or compression force as employed in the exemplary embodiment under discussion, there also could be applied a tension force which is exerted by the pressurized fluid medium cylinder unit 10. Instead of using a hydraulic cylinder arrangement it would also be possible to employ a spring as the power or force-applying means or device.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for oscillating a continuous casting mold for the continuous casting of a strand, comprising:

a fixedly arranged bearing block;

a mold table at which there is mounted the continuous casting mold;

two short oscillation levers for supporting and guiding said mold table during oscillatory movement thereof;

each of said short oscillation levers having opposed ends;

shaft means for hingedly connecting respective ones of said opposed ends of said oscillation levers neighboring said mold table with said mold table;

shaft means for pivotably mounting the opposite opposed ends of said oscillation levers with said fixedly arranged bearing block;

an oscillation drive for moving one of said short oscillation levers about bearing locations thereof in said fixedly arranged bearing block; and a power-applying device operatively connected with said fixedly arranged bearing block and said mold table for producing a force which extends approximately parallel to said oscillation levers for continuously pressing the shaft means thereof in a defined direction at the bearing locations during the oscillatory movement and to thus compensate for any existing bearing play.

* * * * *